US007381926B2

(12) United States Patent
Yudovsky et al.

(10) Patent No.: US 7,381,926 B2
(45) Date of Patent: Jun. 3, 2008

(54) REMOVABLE HEATER

(75) Inventors: Joseph Yudovsky, Campbell, CA (US); Robert C. Cook, Pleasanton, CA (US)

(73) Assignee: Applied Materials, Inc., Santa Clara, CA (US)

( * ) Notice: Subject to any disclaimer, the term of this patent is extended or adjusted under 35 U.S.C. 154(b) by 214 days.

(21) Appl. No.: 11/233,826

(22) Filed: Sep. 9, 2005

(65) Prior Publication Data

US 2007/0056950 A1 Mar. 15, 2007

(51) Int. Cl.
*H05B 1/00* (2006.01)

(52) U.S. Cl. ..... 219/200; 219/385; 219/391; 219/406

(58) Field of Classification Search ..... 219/200, 219/385, 391, 406, 390, 411; 118/715, 724, 118/225, 726; 392/466, 418, 411
See application file for complete search history.

(56) References Cited

U.S. PATENT DOCUMENTS

| | | | | |
|---|---|---|---|---|
| 5,383,984 | A | 1/1995 | Shimada et al. | |
| 6,074,518 | A * | 6/2000 | Imafuku et al. | 156/345.46 |
| 6,111,225 | A * | 8/2000 | Ohkase et al. | 219/390 |
| 6,352,593 | B1 | 3/2002 | Brors et al. | |
| 6,644,963 | B1 * | 11/2003 | Yamada | 432/152 |
| 6,693,947 | B1 | 2/2004 | Schroeder | |
| 6,712,909 | B2 * | 3/2004 | Tometsuka | 118/725 |
| 6,825,051 | B2 * | 11/2004 | AmRhein et al. | 438/9 |
| 6,876,816 | B2 * | 4/2005 | Shigeoka et al. | 392/411 |
| 2003/0049372 | A1 | 3/2003 | Cook et al. | |
| 2003/0175426 | A1 | 9/2003 | Shiratori | |

FOREIGN PATENT DOCUMENTS

| | | |
|---|---|---|
| DE | 226868 | 9/1984 |
| DE | 4434369 | 3/1996 |
| EP | 0504774 | 9/1992 |
| GB | 901723 | 7/1962 |
| JP | 06347169 | 12/1994 |
| JP | 09145249 | 6/1997 |
| WO | 04015742 | 2/2004 |
| WO | 8304161 | 4/2007 |

OTHER PUBLICATIONS

PCT International Search Report dated Mar. 19, 2007 for PCT International Application No. PCT/US2006/034944. (APPM/9826PCT).

* cited by examiner

*Primary Examiner*—Tu Ba Hoang
*Assistant Examiner*—Vinod Patel
(74) *Attorney, Agent, or Firm*—Patterson & Sheridan, LLP

(57) ABSTRACT

A batch processing chamber comprising a top plate having at least one opening, and sidewalls, wherein the sidewalls and the top plate define a process volume. At least one removable heater is generally disposed in the process volume, wherein the at least one removable heater can be inserted or removed from the at least one opening of the top plate. In one embodiment, the at least one removable heater is resistive heater constructed in ceramic. In another embodiment, at least one heater container is disposed in the process volume via the at least one opening of the top plate and the at least one heater may operate in atmospheric conditions.

10 Claims, 8 Drawing Sheets

REMOVABLE HEATER

BACKGROUND OF THE INVENTION

1. Field of the Invention

Embodiments of the present invention generally relate to apparatus and method for heating a batch processing chamber.

2. Description of the Related Art

The term batch processing generally indicates a process step that can process two or more substrates simultaneously in one region. Batch processing has been proven to be effective in increasing device yield and reducing cost of ownership. A batch processing chamber generally processes a batch of vertically stacked substrates within a chamber volume. Process steps performed in a batch processing chamber, such as atomic layer deposition (ALD) and chemical vapor deposition (CVD), generally require substrates to be heated. Therefore, a batch processing chamber generally comprises a heating system configured to heat a batch of substrates uniformly. However, such a heating system may be complicated, difficult to maintain and costly to repair.

FIGS. 1 and 2 illustrate a batch processing chamber known in the art. FIG. 1 illustrates a batch processing chamber 100 in a processing condition. In this condition, a batch of substrates 102 supported by a substrate boat 101 is processed in a process volume 103 defined by a top 104, sidewalls 105, and a bottom 106. An aperture 122 formed in the bottom 106 provides a means for the substrate boat to be inserted into the process volume 103 or removed from the process volume 103. A seal plate 107 is provided to seal off the aperture 122 during a process.

Heating structures 110 are generally mounted on exterior surfaces of each of the sidewalls 105. Each of the heating structures 110 contains a plurality of halogen lamps 119 which are used to provide energy to the substrates 102 in the process volume 103 through a quartz window 109 mounted on the sidewall 105. Thermal shield plates 108 mounted on an inside surface of the sidewalls 105 are added to the process volume 103 to diffuse the energy emitted from the heating structures 110 to provide a uniform distribution of heat energy to the substrates 102.

The sidewalls 105 and the top 104 are generally temperature controlled by milled channels 116 (shown in FIG. 2) formed in the sidewalls 105 to avoid unwanted deposition and for safety reasons as well. When the quartz windows 109 are hot and the process volume 103 is under vacuum, undue stress would cause an implosion if the quartz windows 109 were in direct contact with the temperature controlled sidewalls 105. Therefore, O-ring type gaskets 124 (constructed of a suitable material such as, for instance, viton, silicon rubber, or cal-rez graphite fiber) and strip gaskets 123 of a similar suitable material are provided between the quartz windows 109 and sidewalls 105 to ensure that the quartz windows 109 do not come in direct contact with the sidewalls 105. The thermal shield plates 108 are generally mounted on the sidewalls 105 by insulating strips 125 and retaining clamps 126. The thermal shield plates 108 and the insulating strips 125 are made of a suitable high temperature material such as, for instance, graphite or silicon carbide. The retaining clamps 126 are made from suitable high temperature material such as titanium. The milled channels 116 formed in the sidewalls 105 may be temperature controlled by use of a heat exchanging fluid that is continually flowing through the milled channels 116.

The heating structures 110 are further described in U.S. Pat. No. 6,352,593, entitled "Mini-batch Process Chamber" filed Aug. 11, 1997, and U.S. patent application Ser. No. 10/216,079, entitled "High Rate Deposition At Low Pressure In A Small Batch Reactor" filed Aug. 9, 2002, now published as U.S. Patent Publication No. 2003/0049372 A1, which are incorporated herein by reference.

Referring now to FIG. 2, process gases used in depositing layers on substrates 102 are provided via a gas injection assembly 114. The injection assembly 114 is vacuum sealed to the sidewalls 105 via an O-ring 127. An exhaust assembly 115 is disposed on an opposite side of the injection assembly 114. The sidewalls 105, the top 104 and the bottom 106 are typically made of metals, such as aluminum.

The chamber 100 contains complicated system for heating, vacuum seal and thermal isolation. The heating structures 110 are difficult to assemble and service because special fixtures are required for removal and replacement. Furthermore, limited lamp life also increases manufacturing cost as well.

Therefore, there is a need for a simplified heating system for a batch processing chamber.

SUMMARY OF THE INVENTION

The present invention generally provides a method and apparatus for heating a batch processing chamber.

One embodiment of the present invention provides a batch processing chamber comprising a top plate having at least one opening, and sidewalls, wherein the sidewalls and the top plate define a process volume. At least one removable heater is generally disposed in the process volume, wherein the at least one removable heater can be inserted or removed from the at least one opening of the top plate.

Another embodiment of the present invention provides a batch processing chamber comprising a top plate having at least one opening, and sidewalls, wherein the sidewalls and the top plate define a process volume. At least one removable heater is generally disposed in the process volume, wherein the at least one removable heater can be inserted or removed from the at least one opening of the top plate. The batch processing chamber further comprises at least one heater container disposed in the process volume via the at least one opening of the top plate, wherein the at least one heater is disposed inside the respective at least one heater container.

Yet another embodiment of the present invention provides a batch processing chamber comprising a top plate, a bottom plate and sidewalls sealingly connected to the top plate and bottom plate, wherein the sidewalls, the top plate and the bottom plate define a chamber volume. At least one heater is removably disposed in the chamber volume via at least one opening formed on at least one of the sidewalls, the top plate and the bottom plate.

Yet another embodiment of the present invention provides a batch processing system comprising a chamber body defining a chamber volume, an inject assembly connected to the chamber body and configured to supply the chamber volume with processing gases, an exhaust assembly in fluid communication with the chamber volume, and a plurality of removable heaters disposed in the chamber volume via a plurality of openings formed on the chamber body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally provides a batch processing chamber having at least one removable heater. The invention is illustratively described below in reference to modification of a FlexStar™ system, available from Applied Materials, Inc., Santa Clara, Calif. This invention greatly reduces the number of o-ring seals used. Heaters of in the present invention are economical and basic designs of the heaters can accommodate a variety of control and wattage requirements depending on process temperatures. The heaters may be removed from a top of a batch processing chamber which minimizes required service access.

Figure 1:
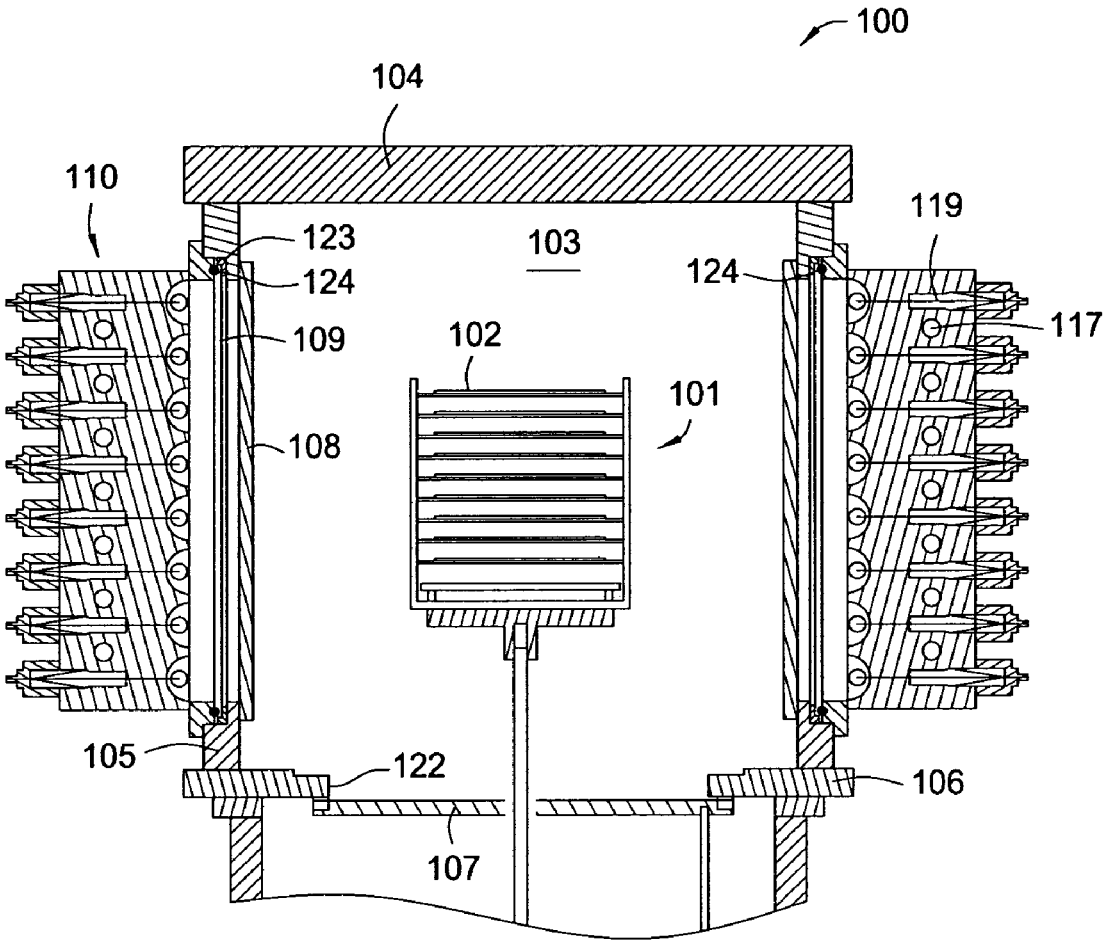
FIG. 1 (PRIOR ART)
FIG. 1 (prior art) illustrates a sectional view of a known batch processing chamber.
Figure 2:
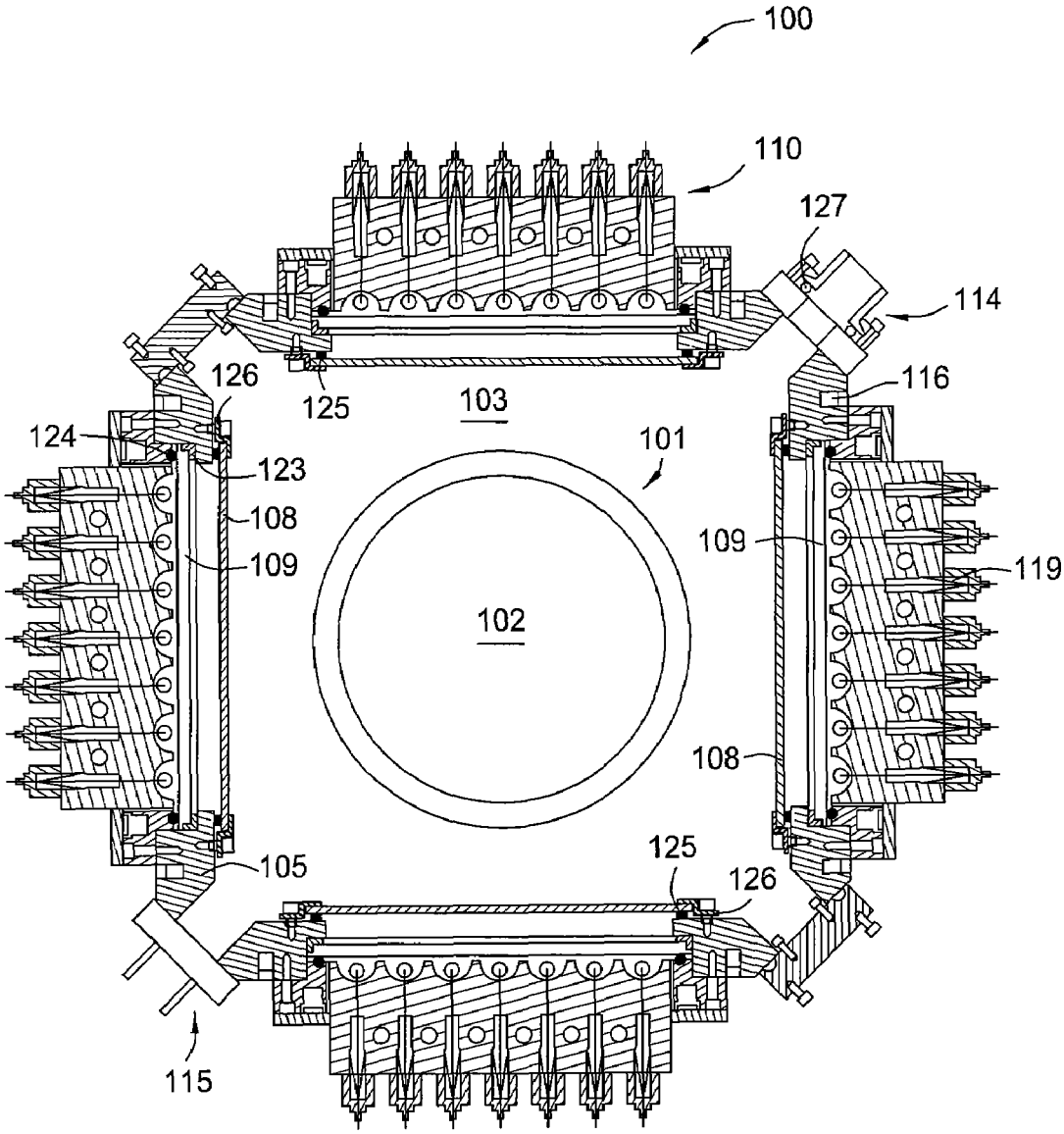
FIG. 2 (PRIOR ART)
FIG. 2 (prior art) illustrates a sectional view the known batch processing chamber of FIG. 1.
Figure 3:
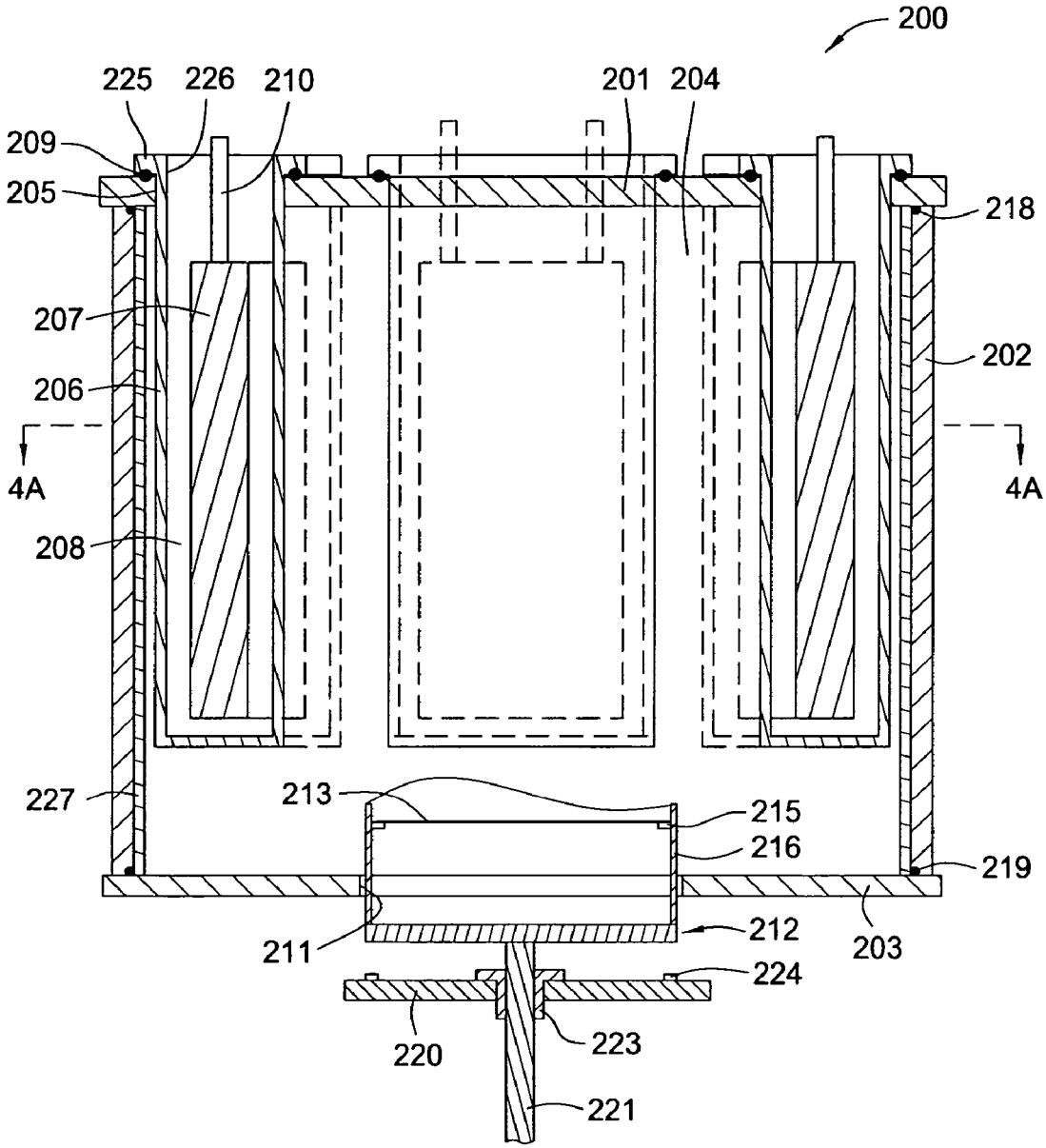
FIG. 3 is a sectional side view of an exemplary batch processing chamber of the present invention.
Figure 4A:
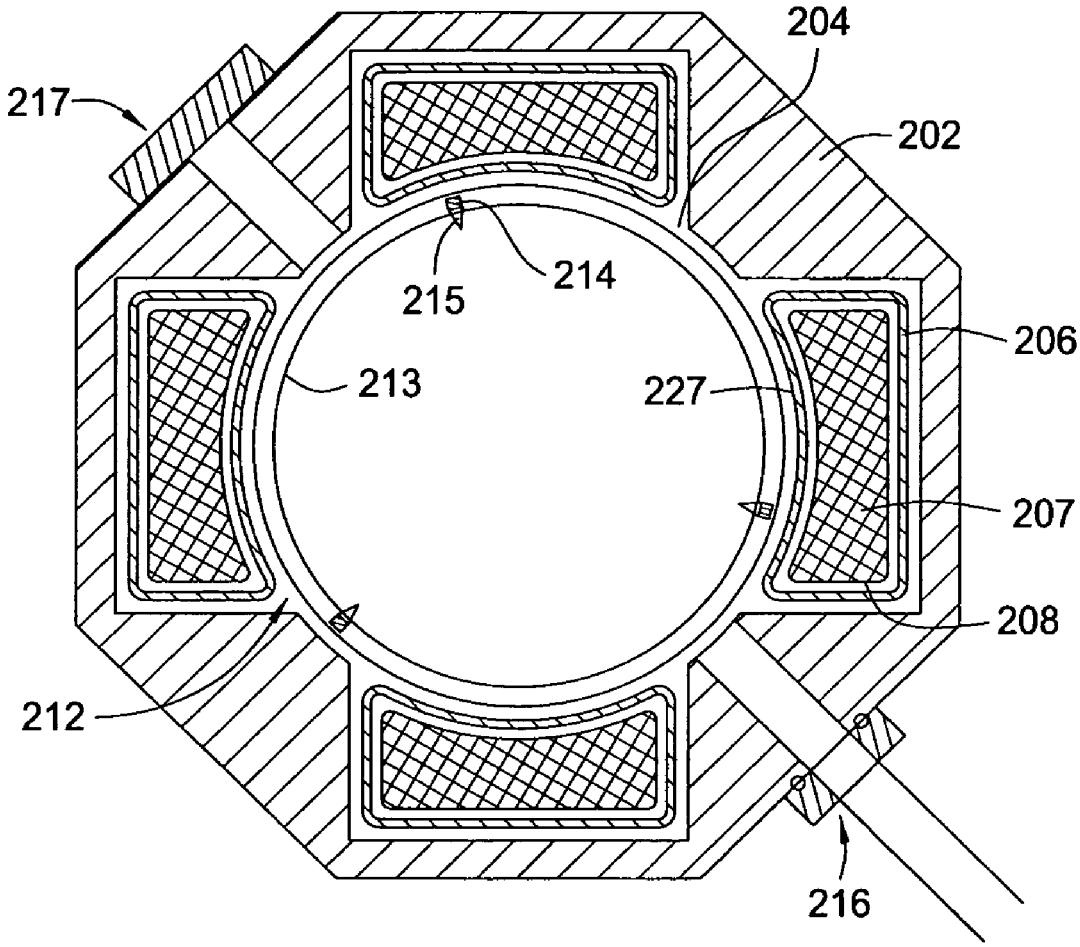
FIG. 4A is a sectional view of the exemplary batch processing chamber of FIG. 3.
Figure 4B:
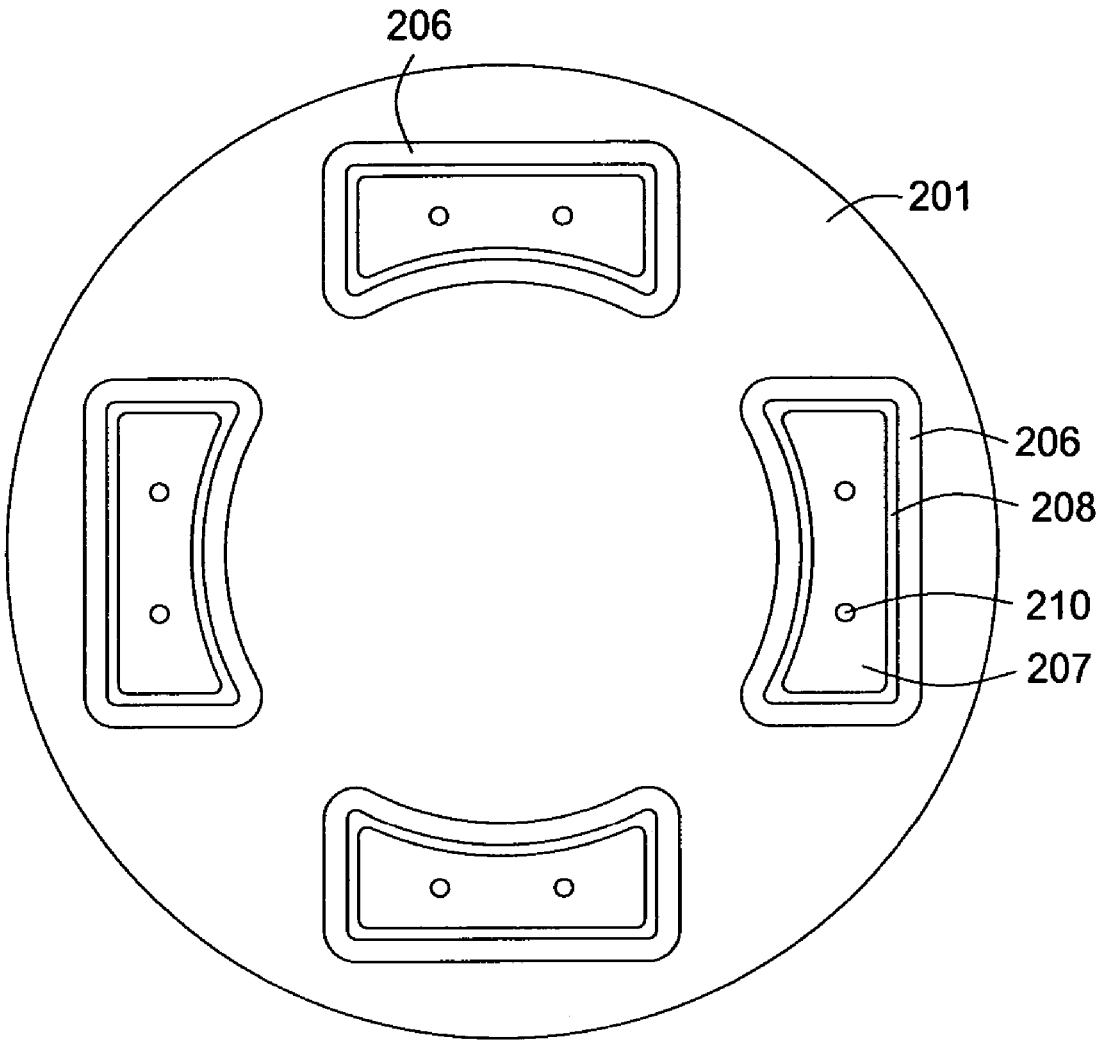
FIG. 4B is a top view of the batch processing chamber of FIG. 3.

FIGS. 3, 4A and 4B illustrate one embodiment of a batch processing chamber 200 of the present invention. Referring to FIG. 3, the batch processing chamber 200 generally has a top plate 201 sealing connected to sidewalls 202. The sidewalls 202 are further connected to a bottom plate 203. In one aspect, O-rings 218 and 219 may be used to implement vacuum seal between the sidewalls 202 and the top plate 201 and between the sidewalls 202 and the bottom plate 203 respectively. A chamber volume 204 is generally defined by the top plate 201, the sidewalls 202, and the bottom plate 203. An aperture 211 is configured for substrates 213 to be shuttled to and from the chamber volume 204. The substrates 213 may be shuttled by a substrate boat 212 (only partially shown). In one aspect, the substrate boat 212 may have at least three support rods 214, each connected to a plurality of support fingers 215 configured to support the substrates 213. A shaft 221 may be extended from the substrate boat 212. The shaft 221 is configured to transfer the substrate boat 212 vertically and to rotate the substrate boat 212 during substrate processing. A seal plate 220 is connected to the shaft 221 via a rotary seal 223. The seal plate 220 is configured to vacuum seal the aperture 211 when the substrate boat 212 is inside the chamber volume 204. In one aspect, a quartz ring 224 may be used to seal between the seal plate 220 and the bottom plate 203. Detailed information of substrate boats are described in the U.S. patent application Ser. No. 11/216,969, filed on Aug. 31, 2005 under the title "Batch Deposition Tool and Compressed Boat", which is incorporated herein by reference in its entirety. In one aspect, the top plate 201, the sidewalls 202 and the bottom plate 203 may be made of metal, such as aluminum.

In one embodiment of the present invention, a plurality of openings 205 may be formed on the top plate 201 near a periphery of the top plate 201. A quartz container 206 configured to enclose a heater assembly 207 is generally inserted in each of the openings 205. In one aspect, each quartz container 206 may have a top opening 226 configured to allow the insertion of the heater assembly 207 and a top flange 225 configured to seal the openings 205 and to hang the container 206 on the top plate 201. Wirings 210 extended from the heater assemblies 207 are configured to supply power and control signals to the heater assemblies 207 may be generally disposed through the top openings 226. O-ring seals 209 are disposed between the openings 205 and the top flanges 225 of the quartz containers 206 to provide sealing for the chamber volume 204. The quartz containers 206 inserted into the openings 205 on the top plate 210 allow a plurality of pocket volumes 208 to be formed within the chamber volume 204. During process, the heater assemblies 207 inserted in the pocket volumes 208 generally surround the substrate boat 212 and heat the substrates 213 along the height of the substrate boats 212. The top openings 226 allow the heater assemblies 207 to be installed or removed without any disassemble of the sidewalls 202, the top plate 201, and/or the bottom plate 203. The pocket volumes 208 may be kept in atmospheric pressure at all time which enables usage of heaters other than vacuum compatible heaters. In one aspect, the heater assemblies 207 may be resistive heaters. In another aspect, each of the heater assemblies 207 may be made of a plurality of independent controllable zones such that heating effect may be adjusted by region. In one embodiment, each heater assembly 207 is made up of five to seven vertical zones which can be controlled independently. In another embodiment, a plurality of quartz insulators 227 may be generally disposed inside the sidewalls 202 to keep the sidewalls 202 from being heated by the heater assemblies 207.

FIG. 4A illustrates a sectional view of the batch processing chamber 200 along the direction A-A shown in FIG. 3. In this embodiment, four heater assemblies 207 enclosed in the quartz containers 206 are disposed around a periphery of the substrate boat 212. In one aspect, each of the quartz containers 206 may have a curved portion 228 facing a center of the chamber volume 204 so that heat energy from the heater assemblies 207 may be evenly distributed to the substrates 213 inside the chamber volume 204. In another aspect, an inject assembly 216 is configured to supply the chamber volume 204 with processing gases and may be generally disposed on the sidewalls 202. An exhaust assembly 217 is configured to pump out the chamber volume 204 and may be generally disposed on the sidewalls 202 on an opposite side of the inject assembly 216. FIG. 4B is a top view of the batch processing chamber 200. In this case, the top plate 201 has a circular shape. The heater assemblies 207 are accessible via the top openings 226 of the quartz containers 206.

Embodiments of the present invention provide a batch processing chamber having a chamber body, such as the top plate 201, the sidewalls 202 and the bottom plate 203 of FIG. 3, and at least one removable heater, for example, the heater assemblies 207 of FIG. 3. The chamber body defines a processing volume, such as the chamber volume of FIG. 3, in which the removable heaters are disposed. At least one heater container, such as the quartz containers 206, may be inserted to the processing volume from the chamber body forming at least one pocket in the processing volume, such as the pocket volume 208 of FIG. 3, to house the at least one removable heater inside the processing volume. Each of the at least one heater container have an opening, such as the top openings 226 of FIG. 3, through which the removable heaters may be inserted and removed.

A batch processing chamber of the present invention enables heating a batch of substrates inside a vacuum chamber through atmospheric heaters outside the vacuum chamber. Compared to halogen lamp heater assemblies, removable heater assemblies are less complicated with less components, lighter in weight, easier to install and maintain, and cost less.

Figure 5:
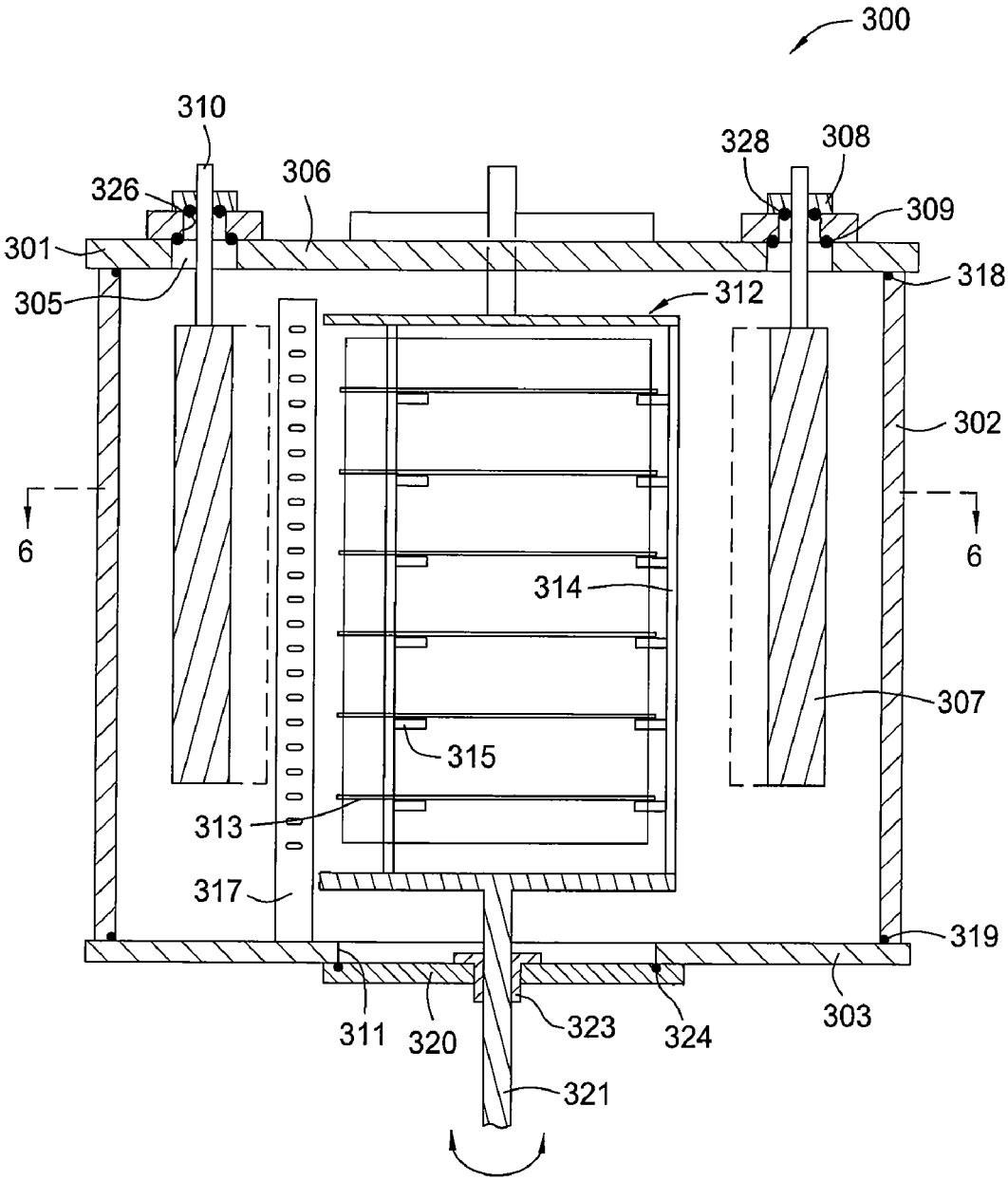
FIG. 5 is a sectional side view of an exemplary batch processing chamber of the present invention.
Figure 6:
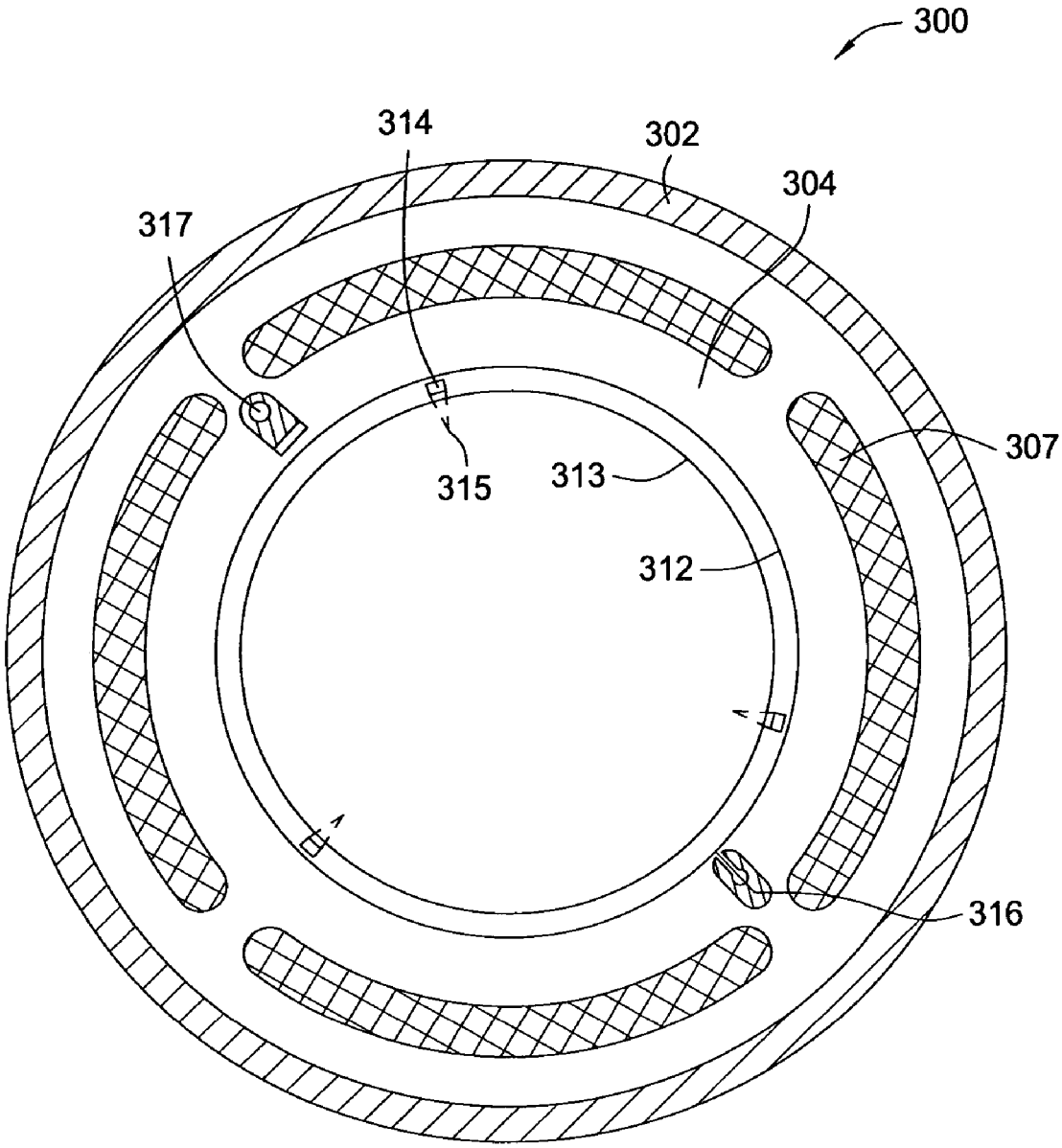
FIG. 6 is a sectional view of an exemplary batch processing chamber of the present invention.

FIGS. 5 and 6 illustrate another embodiment of the present invention. Referring to FIG. 5, the batch processing chamber 300 generally has a top plate 301 sealing connected to sidewalls 302. In one aspect, the top plate 301 may be a circular plate and the sidewalls 302 are connected to the top plate 301 around its periphery. The sidewalls 302 are further connected to a bottom plate 303. In one aspect, O-rings 318 and 319 are used to implement vacuum seal between the sidewalls 302 and the top plate 301 and between the sidewalls 302 and the bottom plate 303 respectively. A chamber volume 304 is generally defined by the top plate 301, the sidewalls 302, and the bottom plate 303. An aperture 311 configured for substrates 313 to be shuttled to and from the chamber volume 304 is constructed on the bottom plate 303. The substrates 313 may be shuttled by a substrate boat 312. In one aspect, the substrate boat 312 has at least three support rods 314, each connected to a plurality of support fingers 315 configured to support the substrates 313. A shaft 321 may be extended from the substrate boat 312. The shaft 321 is configured to transfer the substrate boat 312 vertically and to rotate the substrate boat 312 during process. A seal plate 320 is connected to the shaft 321 via a rotary seal 323. The seal plate 320 is configured to vacuum seal the aperture 311 when the substrate boat 312 is inside the chamber volume 304. In one aspect, a quartz ring 324 may be used to seal between the seal plate 320 and the bottom plate 303.

In one embodiment of the present invention, a plurality of openings 305 may be formed on the top plate 301 near a periphery of the top plate 301. The openings 305 are shaped to allow a plurality of heater assemblies 307 to be inserted/removed into/from the chamber volume 304 via the openings 305. In one aspect, each of the heater assemblies 307 may be curved such that the plurality of heater assemblies 307 forms a cylindrical shell surrounding the substrate boat 312 to heat the substrates 313 therein. In one aspect, the heater assemblies 307 may be vacuum compatible. In another aspect, the heater assemblies 307 may be ceramic heaters which is constructed of a material, such as aluminum nitride, that is impervious to process chemistries, wherein resistive heating elements are hermetically sealed inside the material. In one embodiment, each heater assembly 307 is made up of five to seven vertical zones which can be controlled independently. During processing, the heater assemblies 307 inserted in the chamber volume 304 generally surround the substrates boat 312 and heat the substrates 313 along the height of the substrate boats 312.

A plurality of cover plates 306 are disposed on the top plate 301 and are configured to seal respective openings 305 on the top plate 301. A shaft 310 extended from each of the heater assemblies 307 is generally disposed in an aperture 326 formed on each of the plurality of cover plates 306. The shaft 310 is configured to hold the respective heater assemblies 307 and to house power supply and control signal lines of the heater assemblies 307. A seal cap 308 and a seal ring 328 may be generally used to seal each of the apertures 326. O-ring seals 309 may be disposed between the openings 305 and the cover plate 306 to vacuum seal the chamber volume 304.

FIG. 6 illustrates a sectional view of the batch processing chamber 300 along the direction B-B shown in FIG. 5. In this embodiment, four heater assemblies 307 are disposed around a periphery of the substrate boat 312. In one aspect, an inject assembly 316 configured to supply the chamber volume 304 with processing gases may be generally disposed in the chamber volume 304. An exhaust assembly 317 configured to pump out the chamber volume 304 may be generally disposed on an opposite side of the inject assembly 316.

Figure 7:
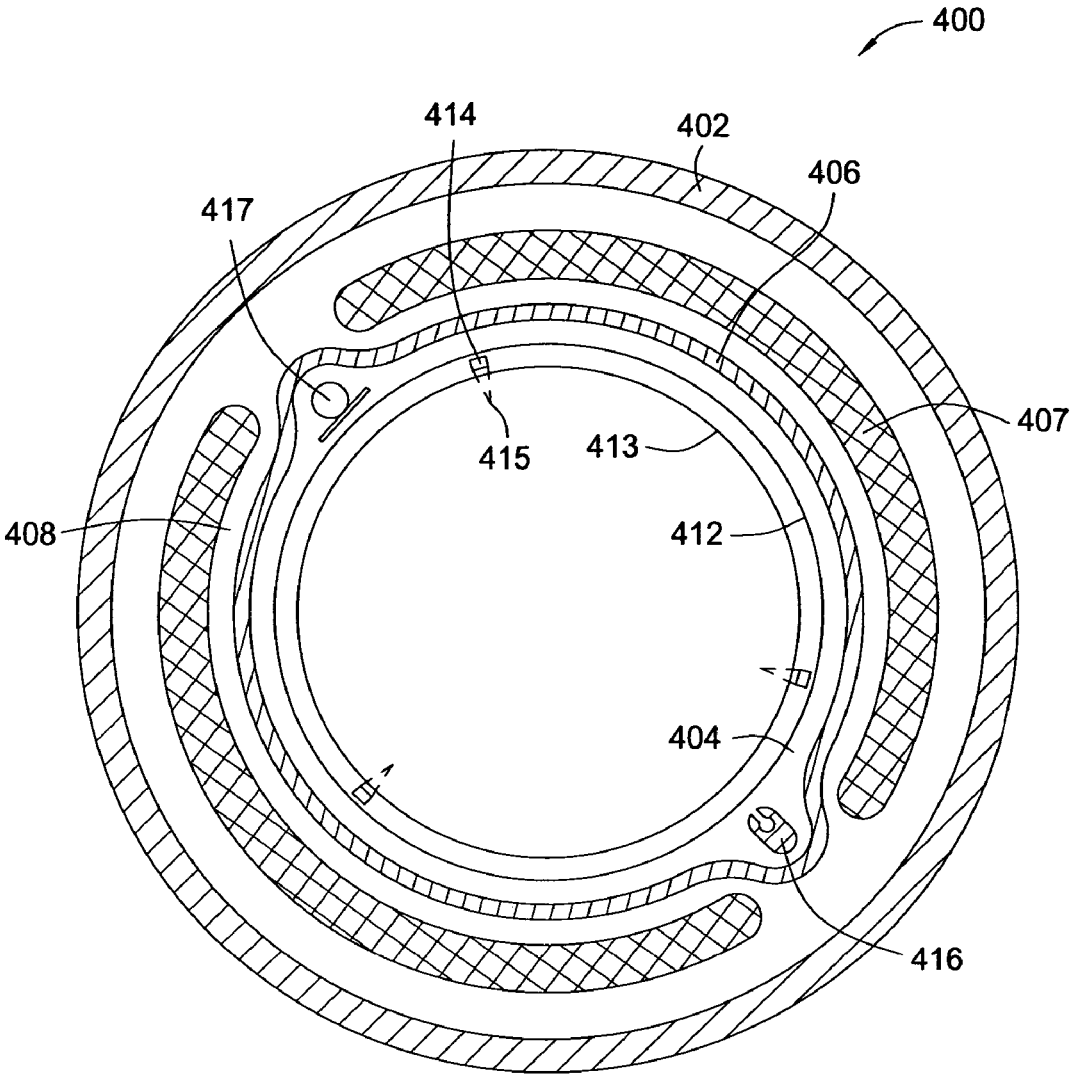
FIG. 7 in a sectional view of an exemplary batch processing chamber of the present invention.

In another embodiment of the present invention shown in FIG. 7, a batch processing chamber 400 may have a quartz jar 406 generally disposed inside an outside chamber 402. The quartz jar 406 is configured to house a substrate boat 412 therein. In one aspect, the quartz jar 406 comprises an inject pocket 416 and an exhaust pocket 417 on an opposite side of the inject pocket 416. At least one heater assembly 407 may be disposed between the quartz jar 406 and the interior of the outside chamber 402. The at least one heater assembly 407 may be installed, removed or exchanged from openings formed on the outside chamber 402. In one aspect, the quartz jar 406 is sealed from the outside chamber 402 and the heater assembly 407 may operate in atmospheric conditions. The processing chamber 400 includes a substrate 413, support fingers 415, support rods 414, inner chamber volume 404, and outer chamber volume 408.

Embodiments of the present invention provide a batch processing chamber having a chamber body, such as the top plate 301, the sidewalls 302 and the bottom plate 303 of FIG. 5, and at least one heater assembly, for example, the heater assemblies 307 of FIG. 5. The chamber body defines a processing volume, such as the chamber volume of FIG. 5, in which at least one heater assembly is disposed via at least one opening, such as the openings 305 of FIG. 5, on the chamber body. The at least one opening may be vacuum sealed by at least one cover, such as the cover plates 306 of FIG. 5. The at least one heater assembly may be installed, removed or exchanged via the at least one opening of the chamber body.

While the foregoing is directed to embodiments of the present invention, other and further embodiments of the invention may be devised without departing from the basic scope thereof, and the scope thereof is determined by the claims that follow.

The invention claimed is:

1. A batch processing chamber comprising:

a top plate;

a bottom plate;

sidewalls sealingly connected to the top plate and bottom plate, wherein the sidewalls, the top plate, and the bottom plate define a chamber volume;

a substrate boat movably positioned in the chamber volume, wherein the substrate boat is configured to support a plurality of semiconductor substrates; and at least one heater removably disposed in a heater container formed in the chamber volume via at least one opening formed in at least one of the sidewalls, the top plate and the bottom plate, wherein the heater container defines a heater volume isolated from the chamber volume so that the heater volume remains atmospheric pressure while the chamber volume is at vacuum, and the at least one heater is curved and forms a cylindrical shell surrounding a substrate boat disposed in the process volume.

2. The batch processing chamber of claim 1, wherein the heater container is disposed in the chamber volume through the at least one opening formed on the top plate.

3. The batch processing chamber of claim 1, wherein the at least one heater is a ceramic resistive heater.

4. The batch processing chamber of claim 1, further comprising at least one insulator disposed between the sidewalls and the at least one heater.

5. The batch processing chamber of claim 1, further comprising a quartz chamber inside the chamber volume, wherein the quartz chamber is surrounded by the at least one heater.

6. A batch processing system comprising:

a chamber body defining a chamber volume;

an inject assembly connected to the chamber body and configured to supply the chamber volume with processing gases;

an exhaust assembly in fluid communication with the chamber volume;

a substrate support movably positioned in the chamber volume, wherein the substrate support is configured to support a plurality of semiconductor substrates; and a plurality of heaters removably disposed in a plurality of heater containers, wherein the plurality of heater containers are disposed in the chamber volume via a plurality of openings formed on the chamber body, each of the plurality of heater containers defines a heater volume isolated from the chamber volume so that the heater volume remains atmospheric pressure while the chamber volume is at vacuum, and each of the plurality of heaters is curved and the plurality of heaters form a cylindrical shell surrounding the substrate support.

7. The batch processing system of claim 6, wherein the plurality of heater containers are quartz containers configured to seal the chamber volume from the plurality of removable heaters.

8. The batch processing system of claim 6, wherein each of the plurality of heaters comprises multiple vertical zones.

9. The batch processing system of claim 6, wherein the plurality of heaters are resistive heaters.

10. The batch processing system of claim 6, wherein the plurality of heaters are ceramic resistive heaters.

* * * * *

UNITED STATES PATENT AND TRADEMARK OFFICE

CERTIFICATE OF CORRECTION

PATENT NO. : 7,381,926 B2
APPLICATION NO. : 11/233826
DATED : June 3, 2008
INVENTOR(S) : Yudovsky et al.

It is certified that error appears in the above-identified patent and that said Letters Patent is hereby corrected as shown below:

In the Detailed Description:

Column 4, Line 16, please delete "210" and insert --201-- therefor.

Signed and Sealed this

Ninth Day of December, 2008

JON W. DUDAS
*Director of the United States Patent and Trademark Office*